United States Patent [19]

Nakagawa et al.

[11] 4,339,938

[45] Jul. 20, 1982

[54] METHOD AND APPARATUS FOR FORMING METAL PIPES AND TUBES

[75] Inventors: Makoto Nakagawa, Chiba; Takeshi Mori, Kitakyushu, both of Japan

[73] Assignee: Nippon Steel Corporation, Tokyo, Japan

[21] Appl. No.: 236,304

[22] Filed: Feb. 20, 1981

Related U.S. Application Data

[63] Continuation of Ser. No. 33,221, Apr. 25, 1979, abandoned.

[30] Foreign Application Priority Data

May 2, 1978 [JP] Japan ..... 53-52281

[51] Int. Cl.[3] ..... B21D 5/12

[52] U.S. Cl. ..... 72/178; 72/181

[58] Field of Search ..... 72/51, 52, 176, 178, 72/181; 228/17.5, 146, 147, 151

[56] References Cited

U.S. PATENT DOCUMENTS

| | | | |
|---|---|---|---|
| 2,012,796 | 8/1935 | Kurtze | 72/181 X |
| 3,722,248 | 3/1973 | Brunken | 72/176 |
| 4,142,663 | 3/1979 | Blatnik et al. | 228/147 |

*Primary Examiner*—Ervin M. Combs

*Attorney, Agent, or Firm*—Wenderoth, Lind & Ponack

[57] ABSTRACT

A flat skelp is longitudinally fed through convex and concave horizontal rolls, and is edge-crimped so that both edges are curved inward symmetrical to the pass line. The edge-crimped skelp is forced through a plurality of cage rolls disposed along and symmetrical to the pass line. The cage rolls perform intermediate forming that shapes mainly the uncrimped portion of the skelp toward a round form symmetrical to the pass line. The nearly rounded skelp is then subjected to finish-forming, with the fin of a finned-roll inserted in the gap between the edges. The edge-crimping process includes two or more stages; bending the outermost edges of the skelp and subsequent bending of the inward portion adjacent to the first bent edges.

2 Claims, 12 Drawing Figures

METHOD AND APPARATUS FOR FORMING METAL PIPES AND TUBES

The present application is a continuation application of Ser. No. 33,221 filed Apr. 25, 1979, abandoned.

BACKGROUND OF THE INVENTION

This invention relates to a method and apparatus for forming metal pipes and tubes, especially welded pipes and tubes the seam line of which extends parallel to the longitudinal axis thereof.

In the manufacture of such welded pipes and tubes as electric-welded pipes and tubes the seam line of which extends parallel to the longitudinal axis thereof, a skelp or a strip preslit to a required size is shaped by forming rolls into an almost closed circle, then both edges thereof, facing each other, are welded together. Conventionally, the following methods have been known for preforming the skelp for such welded pipes and tubes.

The first method is known as step roll forming. This method performs stepwise forming operations on a skelp longitudinally threaded through several pairs of horizontal rolls and vertical side rolls disposed along the pass line. In the initial stage, the entire flat skelp, slit to a desired size, is bent by, for example, three pairs of curved horizontal rolls. The degree of bending is not necessarily fixed. The flat skelp is shaped into a U-form instep. In the intermediate stage, the U-shaped skelp is shaped into an O-form, further bending the edges and center thereof by, for example, three pairs of vertical side rolls and one pair of curved horizontal rolls disposed at suitable intervals. By the initial and intermediate stages, the skelp is shaped very close to the desired finished pipe or tube. In the final stage, finned-rolls, each having a circumferential fin, coin the opposite skelp edges to make them ready for welding.

As described above, the step roll forming method forms a pre-slit sklep into a circular form. The shape of the skelp changes rather greatly at each pair of forming rolls, because not many pairs of forming rolls are disposed at intervals along the pass line. This results in springback and stepped edges of the formed skelp. Because of this arrangement which carries out heavy fabrication at each pair of forming rolls, the edges of the skelp become longitudinally elongated at the entrance of each stand, then longitudinally compressed as it draws close to the rolls, and further compressed on leaving the rolls. In the finish-forming stage where individual forming rolls exert great restraining forces, compressive force works on the edges elongated in the initial and intermediate stages. When the skelp is thick enough, this compressive force is absorbed as compressive strain. But thinner skelps are likely to develop longitudinal buckling.

A second method is known as cage roll forming or natural function forming. According to this method, a skelp is preformed into a simple arched shape by a pair of curved horizontal rolls, then given an edge-forming pass through a pair of edge-forming rolls. Following such initial preforming and edge-forming, the skelp passes through a number of small idle rolls or cage rolls disposed along the pass line, whereby the skelp is progressively and smoothly pressed inward from the outside of an O-form. The skelp formed by this method has hardly any vertical bend, springback, edge elongation or buckling. A tube mill according to U.S. Pat. No. 3,472,053 is an example of equipment to carry out the forming operation of this type.

But this cage roll forming method forms the skelp edges to only minor curvatures in the initial and intermediate stages, as compared with the final curvature of the finished pipe or tube. The entire width of the skelp also is bent to a limited degree. The greater part of edge-forming is accomplished by the finned-rolls in the finish-forming stage. Accordingly, this finish-forming calls for a large forming load and, therefore, a very rigid finish-forming apparatus. If the forming load and apparatus rigidity are low, it is difficult to form a square groove, necessary for performing satisfactory butt welding, between the edges of the rounded skelp.

SUMMARY OF THE INVENTION

This invention has solved the aforementioned difficulties in the forming of metal pipes and tubes.

An object of this invention is to provide a method and apparatus for forming metal pipes and tubes which shape a flat metal plate into a smooth circular form, which has no irregular edge unfavorable for butt welding.

Another object of this invention is to provide a method and apparatus for forming metal pipes and tubes which permit reducing the rigidity of the finish-forming load and finish-forming apparatus.

To achieve the above objects, the method and apparatus of this invention edge-crimp a flat skelp, which is longitudinally fed through convex and concave horizontal rolls, so that both edges thereof are curved inward symmetrical to the pass line. The edge-crimped skelp is forced through a plurality of cage rolls disposed along and symmetrical to the pass line. The cage rolls perform intermediate forming that shapes mainly the uncrimped portion of the skelp toward a round form symmetircal to the pass line. The nearly rounded skelp is then subjected to a finish-forming, with the fins of finned-rolls inserted in the gap between the edges. The edge-crimping process comprises two or more stages; bending the outermost edges of the skelp and subsequent bending of the inward portion adjacent to the first bent edges.

DETAILED DESCRIPTION OF THE PREFERRED EMBODIMENTS

Figure 1:
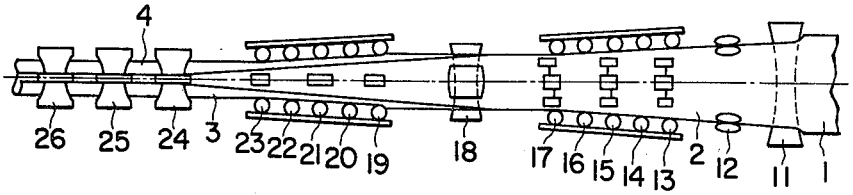
FIG. 1 PRIOR ART
FIG. 1 is a plan view showing the arrangement of forming rolls in a conventional tube mill based on the cage roll forming principle.

To help understand this invention, the aforementioned conventional cage roll forming method will be described in greater detail. FIG. 1 is a plan view that shows the arrangement of forming rolls in a tube mill carrying out the conventional cage roll forming method. First, a longitudinally fed, flat skelp 1 is preformed into a lightly arched shape across the entire width thereof, passing through a pair of curved rolls 11, one installed above the other. Then, a following pair of edge-forming rolls 12 bends the edges of the skelp further inward. Following this initial stage, the lightly formed skelp 2 undergoes intermediate forming that brings its cross section progressively toward a circular form, passing through cage rolls 13 through 17, curved horizontal rolls 18, and cage rolls 19 through 23. The semi-circular skelp 3 is then finish-formed by finish-rolls 24, 25 and 26.

Figure 2:
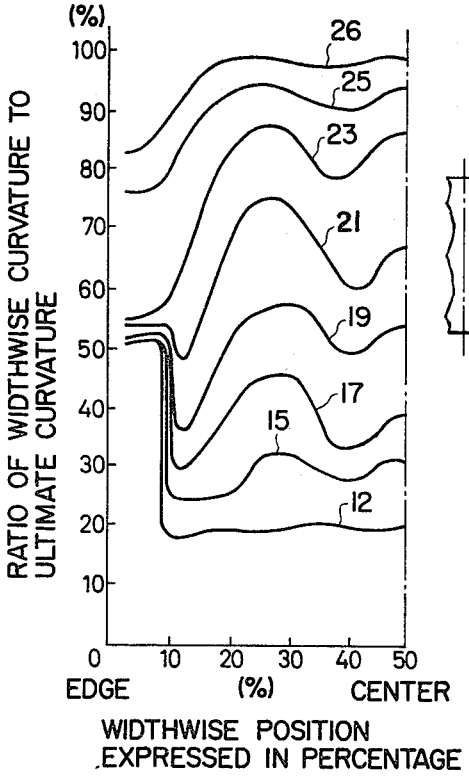
FIG. 2 PRIOR ART
FIG. 2 is a graphic representation of stepwise changes in the cross-sectional shape of a skelp rounded by the conventional cage roll forming method.

FIG. 2 shows stepwise changes in the cross-section of the skelp formed by the above-described method. This skelp has a yield point of 40 kg/mm$^2$. The finished pipe has a 508 mm outside diameter and a 12.7 mm wall thickness. In FIG. 2, the x-axis of the graph shows the widthwise position on the skelp expressed in terms of percentage of the overall width, and the y-axis the widthwise curvature of the skelp in terms of percentage of the final curvature. Reference numerals given to plotted curves correspond to those for the forming rolls in FIG. 1. As evident from FIG. 2, the edge of the skelp, accounting for approximately 10 percent of the entire width, is bent in one process, to a curvature equivalent to approximately 50 percent of the final curvature. With this limited initial bending, both in width and curvature, however, the skelp cannot be finish-formed into a satisfactory round form. In FIG. 2, the curve 26 plots a cross section finish-formed on the finned-roll 26. As seen, the curvature in an approximately 20-percent-wide edge is considerably smaller than the final curvature. A finish-formed skelp should have square edges facing each other. But the skelp represented by the curve 26 does not have a satisfactorily circular cross section, with the edges thereof opened up-ward. Curves 23 to 25 indicate a considerable change in curvature and cross-sectional shape, which suggests that finish-forming requires a large forming load.

Figure 3:
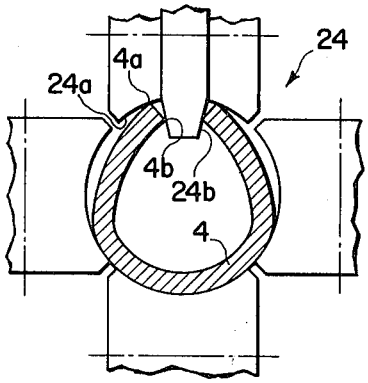
FIG. 3 PRIOR ART
FIG. 3 is a front view of a skelp being finish-formed according to the conventional cage roll forming method, using a finned roll.
Figure 4:
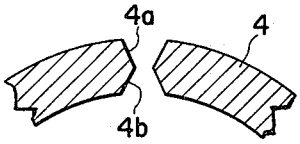
FIG. 4 PRIOR ART
FIG. 4 is an enlarged cross section of the skelp edges finish-formed by the finned roll in FIG. 3.

If edge-formed only to a limited curvature and width as described above, a heavy-gauge skelp would develop abrasive wear in its edges. The edges of a skelp 4 shown in FIG. 3 are insufficiently preformed. In the initial stage of finish-forming, corners 4*a* and 4*b* of the edge thereof wear down, partially by coming in contact with the arched surface 24*a* and side 24*b* of the fin of the finned-roll 24. FIG. 4 shows the worn edge corners 4*a* and 4*b* of the skelp 4. The two edges do not form a required square groove, but rather form a double V groove instead. Contact with the edge corners 4*a* and 4*b* damages the arched roll surface 24*a* and the side 24*b* of the fin, too.

This invention solves the above problems with the conventional forming method by increasing the curvature and width of edge-forming. The following is a detailed description of a pipe forming method and apparatus according to this invention.

Figure 5:
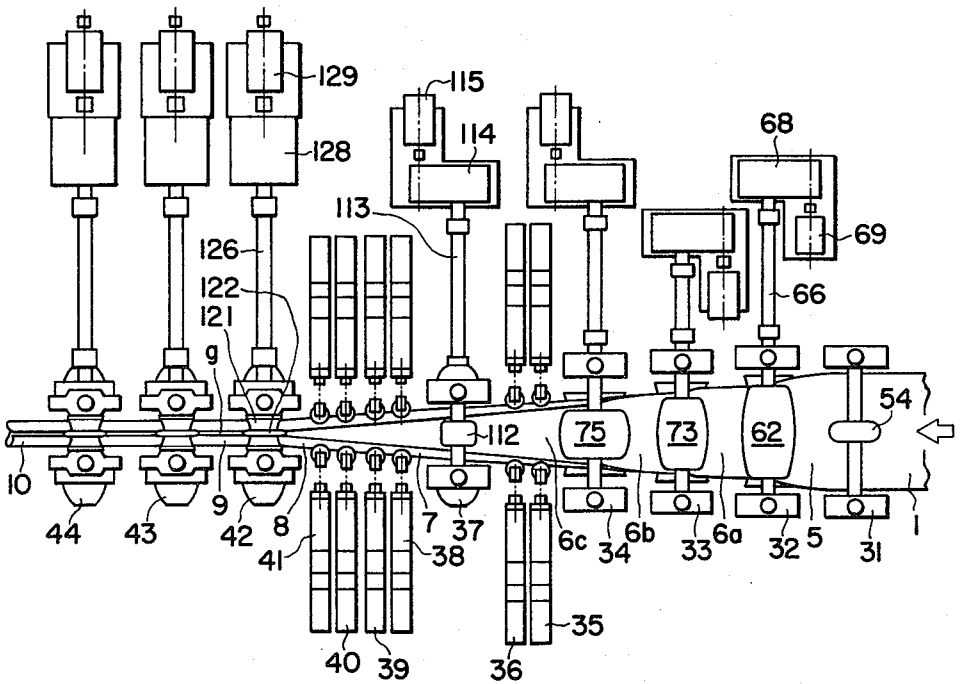
FIG. 5 is a plan view of a tube mill for carrying out the forming method of this invention.
Figure 6:
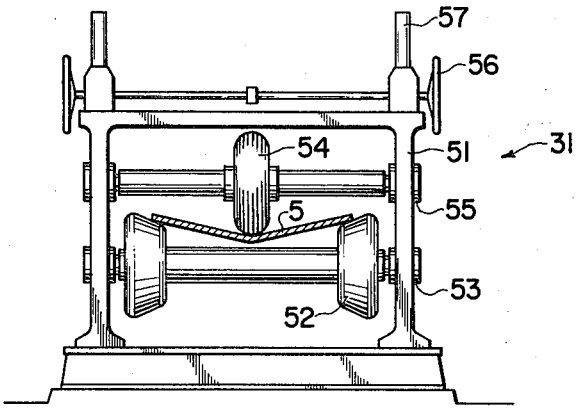
FIG. 6 is a front view of a preforming stand forming part of the mill shown in FIG. 5.

Fed longitudinally as shown in FIG. 5, a flat skelp 1 enters a preforming stand 31. As shown in FIG. 6, the preforming stand 31 comprises a gate frame 51 carrying a pair of rotatable bottom horizontal rolls 52, which support both edges of the bend skelp 5, in bearings 53. The surface of each bottom horizontal roll 52 is generally frustoconical so that the skelp 5 changes its shape in conformity therewith due to the reaction with the edge bending surfaces of rolls 52. The gate frame 51 carries a rotatable top horizontal roll 54, which depresses the center of the skelp 5, in bearings 55, too. The horizontal rolls 52 and 54 bend the skelp 5 into a cross-section which is an obtuse-angled V shape. The gap between the top and bottom horizontal rolls 54 and 52 is adjusted by raising and lowering the bearing 55 by a screwdown mechanism 57 that is operated by rotating a handle 56.

This across-the-width light preforming, preceding edge-forming, reduces edge elongation on light-gauge skelps and helps heavy-gauge skelps to enter subsequent horizontal forming rolls. By combining this preforming with a downhill pass line, waving of stretched edges on light-gauge skelps can effectively be prevented, too. Here, downhill means inclining the lowest portion of a skelp from a table preceding the preforming stand 31 to a cage roll stand 41 in FIG. 5. The amount of inclination varies from approximately one-half to one time the outside diameter of the pipe to be fabricated.

Figure 7:
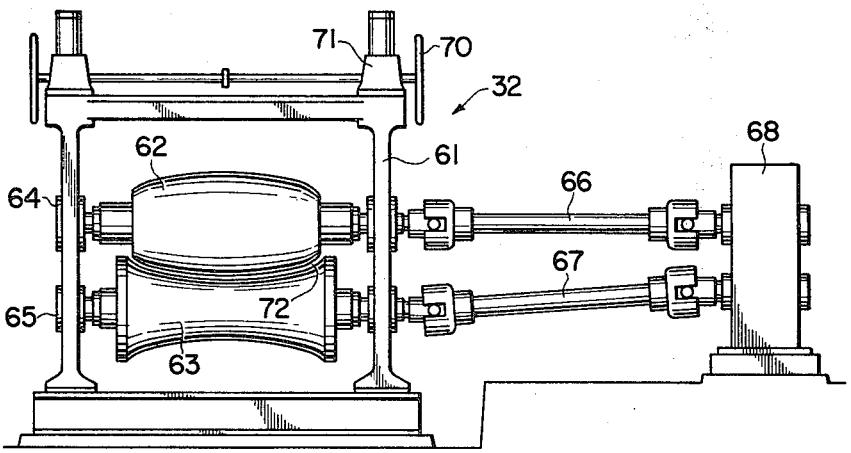
FIG. 7 is a front view of an edge-forming stand forming part of the mill shown in FIG. 5.

The preformed skelp 5 is then subjected to edge-forming in three edge-forming stands 32, 33 and 34. FIG. 7 is a front view of the first edge-forming stand 32. The edge-forming stand 32 comprises a gate frame 61 that carries a convex top horizontal roll 62 and a concave bottom horizontal roll 63, both rotatable, in respective bearings 64 and 65. A motor 69 drives the top horizontal roll 62 through a shaft 66 and a reduction gear 68, and the bottom horizontal roll 63 through a shaft 67 and a reduction gear 68. The bearing 64 supporting the top horizontal roll 62 is mounted on to the frame 61 so as to be moved up and down. A screwdown mechanism 71, operated by turning a handle 70, raises and lowers the bearing 64, thereby adjusting the gap between the top and bottom rolls.

The second and third edge-forming stands 33 and 34 also are similar to the above-described first edge-forming stand 32.

Both the top and bottom horizontal rolls 62 and 63 on the first edge-forming stand 32 are substantially straight in the middle and curved toward both ends. Both rolls are curved with the same curvature, which ranges between 70 percent and 100 percent of the curvature r of the finished pipe. Accordingly, the portions extending inwardly from the edges of the skelp 5 are preformed in a pass 72 between the top and bottom horizontal rolls 62 and 63 are curved with a curvature corresponding to 70 to 100 percent of the curvature r of the finished pipe.

The top and bottom horizontal roll 73 and 74 on the second edge-forming stand 33, following the first edge-forming stand 32, and rolls 75 and 76 on the third edge-forming stand 34 are shaped similar to those on the first edge-forming stand 32, but the roll length in the second and third stands becomes progressively shorter.

Figure 8:
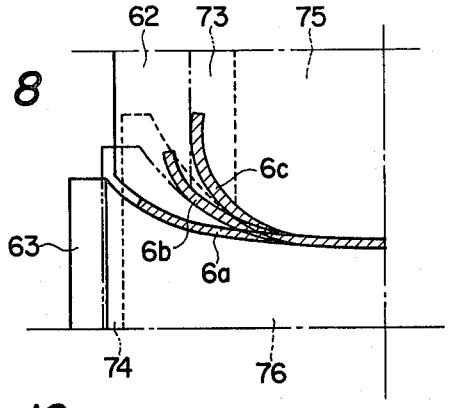
FIG. 8 is a schematic diagram showing cross-sectional changes in the skelp being edge-formed, in which the rolls of three edge-forming stands are projected overlappingly.

FIG. 8 shows how edge-forming is performed in the three edge-forming stands. On leaving the top and bottom horizontal rolls 62 and 63 on the first edge-forming stand 32, the skelp 6*a* with the portions adjacent the edges bent as shown at 6*a* passes through between the top and bottom horizontal rolls 73 and 74 of the second edge-forming stand 33 where a portion adjacent to and next inwardly from the bent edge is bent to the same curvature so that the skelp is bent at 6*b*. The top and bottom horizontal rolls 73 and 74 of the second edge-forming stand 33 are shorter than the rolls on the first edge-forming stand 32 so that they will not contact the bent portions bent in the first edge forming stand. Similarly, the top and bottom horizontal rolls 75 and 76 of the third edge-forming stand 34 bend an area just inwardly of the portion bent on the second edge-forming stand 33 to shape the skelp as at 6*c*. Consequently, the width of the portion inwardly of each edge which is thus bent amounts to between 12.5 and 25 percent of the overall skelp width.

As mentioned before, the skelp edge is bent to a curvature that is not less than 70 percent of the curvature r of the finished pipe. A curvature below 70 percent would call for large finish-forming load and damage the skelp edge corners and finned-roll surface. A curvature over 100 percent, conversely, would make it impossible to obtain good square edges facing each other.

The width of the skelp subjected to edge-forming is limited to between 12.5 and 25 percent of the overall skelp width. Cage roll stands can hardly bend a narrow edge portion that is less than 12.5 percent of the skelp width. But they can bend a middle portion ranging in width between 25 and 50 percent of the skelp width. Edge bending of a portion of the width less than 12.5 percent leads to insufficient forming, which in turn prevents reducing the finish-forming load and producing a good groove for welding. Further, the forming rolls rotating at different rates on the middle and edges of the skelp cause slip marks thereon. Therefore, the width of edge-bending should desirably be held between 12.5 and 25 percent of the skelp width, depending on the forming rate and product pipe size. Also, when the bending curvature is large, increasing the bending width will cause roll slip marks in the skelp edge. So the bending curvature and width should be selected based on their interrelationship.

In the above-described embodiment, the portion of the edge of the skelp subjected to edge-forming is progressively increased through the three edge-forming stands. To accomplish the same degree of bending on a single edge-forming stand, a very wide edge area would have to be bent with a larger curvature, whereby scratches might occur in such portions of the skelp where the running speeds of the skelp and forming rolls differ appreciably. To eliminate this shortcoming, this invention employs a plurality of edge-forming stands so that one narrow width edge portion after another is bent stepwise. The number of edge-forming stands is not limited to three as is the case with the above-described embodiment; it may be two, four or more depending on the size of product pipe desired. The edge-forming rolls may be either idle or power-driven. The power driven rolls impart feeding force to the skelp.

As shown in FIG. 5, the edge-bent skelp 6*c* undergoes intermediate forming on cage roll stands 35 through 41.

Figure 9:
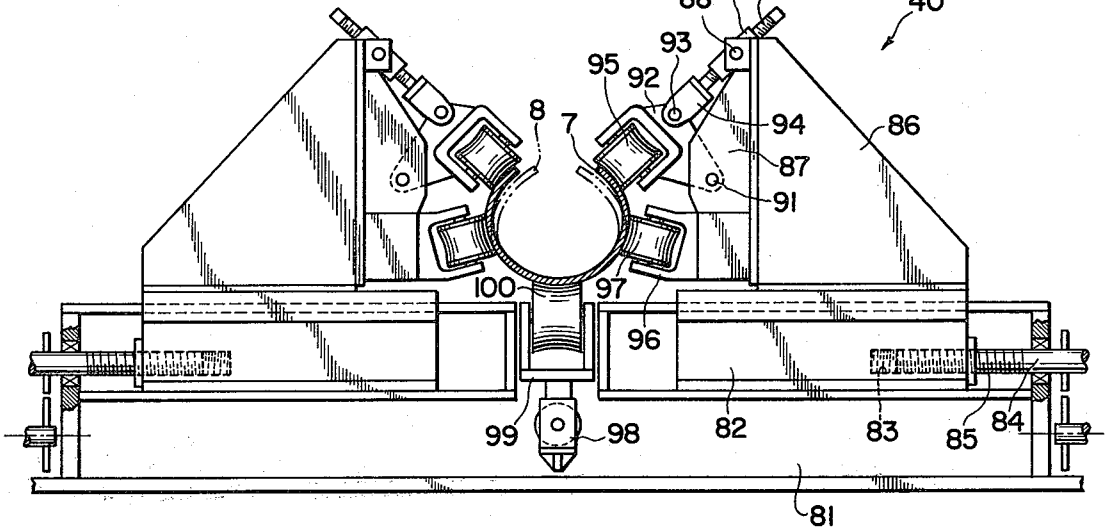
FIG. 9 is a front view of a cage roll stand forming part of the mill shown in FIG. 5.

FIG. 9 is a front view showing details of the sixth cage roll stand 40. As seen, paired movable tables 82 rest on a bed 81, symmetrical to the pass line. The bed 81 supports a rotatable driven shaft 84 with a threaded part 85. The threaded part 85 engages with a threaded hole 83 in the movable table 82. On rotating the drive shaft 84 by a power supply unit (not shown) comprising a motor, reduction gear, etc., the movable table 82 moves sideways over the bed 81.

The movable table 82 carries a frame 86 extending upward. A bracket 87 is fixed to that side of the frame 86 which faces the pass line. A threaded sleeve 89 is rotatably by a pin 88 on the top of the bracket 87. The threaded part of an advance-and-retract shaft 90 is engaged with the threaded sleeve 89. A roll-support arm 92 is rotatably mounted on a pin 91 at a point approximately intermediate between the top and bottom of the bracket 87. The roll-support arm 92 carries a rotatable connecting member 94 on a pin 93. One end of the advance-and-retract shaft 90 is reciprocally and rotatably coupled to the connecting member 94.

The roll-support arm 92 rotatably carries a slightly concave top cage roll 95. A pair of top cage rolls 95 obliquely depress the skelp in the vicinities of the edges of the almost rounded skelp 7 on both sides of the pass line.

A roll-support arm 96 is fixed on the lower portion of the bracket 87. This roll-support arm 96 rotatably carries a slightly concave bottom cage roll 97. A pair of bottom cage rolls 97 obliquely press the lower portion of the almost rounded skelp 7 upwardly on both sides of the pass line.

By adjusting the position of the bed 81 and advance-and-retract shaft 90, the cage rolls 95 and 97 are brought into such positions as are suited for the size of finished pipe.

A base 98 is mounted on to the bed 81. The base 98 carries a roll-support table 99 on which a support roll 100 to support the skelp 7 is rotatably mounted. The base 98 includes an up-down mechanism (not shown) which raises and lowers the roll-support table 99.

The other cage roll stands 35, 36, 39 and 41 are all built similar to the sixth cage roll stand 40 described above; however the third cage roll stand 37 is an exception. As shown in FIG. 5, the third cage roll stand 37 comprises a non-driven cage roll 111 and a curved horizontal roll 112 that is rotated by a motor 115 through a spindle 113 and a reduction gear 114. A support roll (not shown) positioned below the skelp 7 also is rotated. The curved horizontal roll 112 and this support roll hold the skelp 7 therebetween to bend and drive the skelp 7 forward. Throughout the cage roll stands thus arranged, the roll gap becomes increasingly narrower in the direction of movement of the skelp. Namely, the rolls are positioned closer to the pass-line of each stand. Forcibly threaded therethrough, the skelp is shaped toward the round form, with the portion on the inside of the prebent edge mainly being the portion which is continously formed.

The number of the cage roll stands is not limited to five as in the above-described embodiment; it may be, for example, three or otherwise.

Following the intermediate forming on the above-described cage roll stands, the skelp 8 is finish-formed in the first, second and third finish-forming stands 42, 43 and 44, each having a finned roll, as shown in FIG. 5. The first finish-forming stand 42 comprises a finned roll 121 on top of a support roll (not shown), and a pair of vertical rolls (not shown) disposed symmetrically. These four rolls form a round pass. Through a shaft 126 and a reduction gear 128, a motor 129 drives the finned roll 121 that performs finish-forming, with the fin 112 thereof inserted in a gap g between the edges of the almost O-shaped skelp 8. The second and third finish-forming stands 43 and 44 also are built similar to the first finish-forming stand 42, except that the fin width decreases and the roll pass approximates an exact circle the further it is along the pass line.

A welder (Not shown) follows the finish-forming stand 44.

Figure 10:
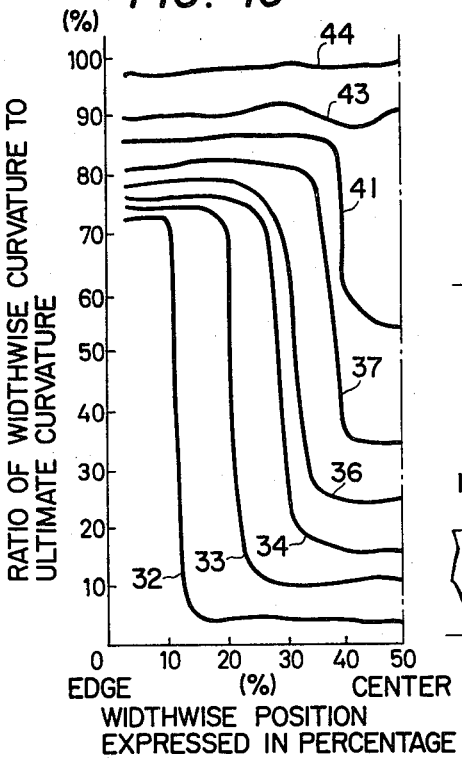
FIG. 10 is a graphic representation of the step-by-step changes in the cross-sectional shape of a skelp rounded by the cage roll forming method of this invention.

FIG. 10 shows stepwise changes in the cross-sectional shape of a skelp rounded by the above-described forming apparatus. The skelp is the same as the one shown in FIG. 2, having a yield point of 40 kg/mm. The product pipe has a 508 mm outside diameter and a 12.7 mm wall thickness. The X- and y-axis represent the same values as in FIG. 2, with reference numbers given to curves corresponding to those affixed to the forming stands in FIG. 5. As is evident from this graph, the portions of the skelp which are successively bent extend inwardly from the edge in approximately 8 percent increments, on the average, on the three edge-forming stands 32, 33 and 34. On the ultimate stand, an area corresponding to approximately 25 percent of the skelp width is bent at a curvature of approximately 75 percent. This is different from the case of FIG. 2, and reduces the amount of finish-forming and, therefore, the load required therefor. The curvature of the finish-formed skelp is substantially 100 percent and uniform throughout the entire width. This means that the skelp is shaped to an almost closed circle.

Figure 11A:
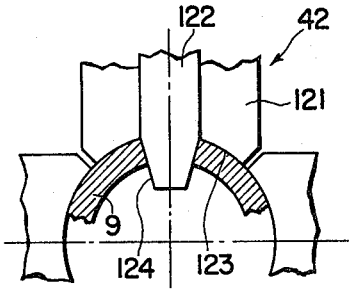
FIGS. 11*a* and 11*b* are front views showing how a skelp is finish-formed with a finned-roll according to the method of this invention, FIG. 11*a* showing the initial stages and FIG. 11*b* the final stage.
Figure 11B:
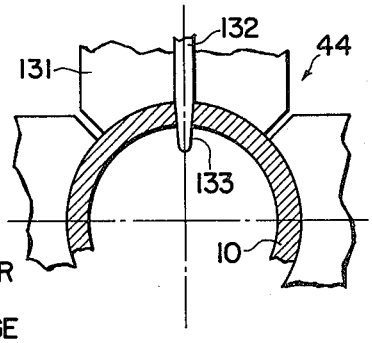

FIG. 11*a* shows the forming condition in the first finish-forming stand 42 with the finned roll 121. The edge of the skelp 9 closely contacts a fin side 124. Unlike the case of FIG. 3, edge corners do not come in partial contact with the side 124 of the find or with roll surface 123. FIG. 11*b* shows the forming condition in the third finish-forming stand 44 with a finned roll 131. The edge of the skelp 10 closely contacts a suitably tapered side 133 of the fin, so that the two edges form a square groove ideal for welding.

Although the embodiment of FIG. 5 has seven cage roll stands and three finish-forming stands, their numbers are not limited thereto, but may be increased or decreased depending on the size of the product pipe. The finned-rolls need not to be driven on all finish-forming stands.

What is claimed is:

1. A method of forming metal pipes and tubes for a skelp by laterally bending the skelp, which method comprises:

passing the skelp between convex and concave horizontal rolls for, while keeping the middle portion of the skelp substantially straight, edge-forming successively more inward parts of the edge portion on each side of the skelp, which parts together extend inwardly up to a distance inward of the edge of from 12.5% to 25% of the width of the skelp and symmetrical to the pass line, for giving each part from 70 to 100% of the ultimate curvature thereof in the finished pipe;

forcing the edge-formed skelp through a plurality of cage roll passes disposed along and symmetrical to the pass line for intermediate forming the remaining portion of the skelp toward a round form symmetrical to the pass line; and forcing the thus intermediate formed skelp through at least one finishing pass having a plurality of finishing rolls for shaping the skelp to the final shape and inserting the fin of a finned roll in the finishing pass into the gap between the skelp edges for finish-forming the skelp.

2. An apparatus for forming metal pipes and tubes from a skelp which comprises:

a plurality of edge-forming stands disposed along a pass line and each having a convex roll and a concave roll disposed relative to each other to form between them a curved pass symmetrical to the pass line, the rolls of the successive stands in the direction of movement of the skelp through the stands being successively shorter, and the profiles of the successive pairs of rolls having curvatures for, while keeping the middle of the skelp substantially straight, bending successively more inward parts of each edge portion of the skelp, which parts together extend inwardly of the skelp a distance up to a distance from 12.5% to 25% of the width of the skelp and symmetrical to the pass line, to give it a curvature of from 70 to 100% of the ultimate curvature thereof in the finished pipe;

a plurality of cage roll stands positioned along the pass line subsequent of the edge-forming stands and each comprising pairs of cage rolls symmetrical to the pass line, and the cage rolls having successively decreasing size roll gaps in the direction along the pass line, for shaping the edge-formed skelp toward a round form symmetrical to the pass line; and a plurality of finish-forming stands positioned along the pass line subsequent to the cage roll stands and each comprising a plurality of concave finishing rolls and a finned roll positioned in the pass for having the fin thereof inserted in the gap between the edges of the nearly rounded skelp.

* * * * *